US007817058B2

(12) United States Patent
Waterhouse

(10) Patent No.: US 7,817,058 B2
(45) Date of Patent: Oct. 19, 2010

(54) SERVER SIGNALER

(76) Inventor: William H. Waterhouse, P.O. Box 722274, Norman, OK (US) 73070

( * ) Notice: Subject to any disclaimer, the term of this patent is extended or adjusted under 35 U.S.C. 154(b) by 990 days.

(21) Appl. No.: 11/195,229

(22) Filed: Aug. 2, 2005

(65) Prior Publication Data

US 2007/0030163 A1 Feb. 8, 2007

(51) Int. Cl.
*G08B 5/00* (2006.01)

(52) U.S. Cl. ..... 340/815.4; 340/286.09; 340/286.06; 340/332; 340/321; 362/162; 362/188

(58) Field of Classification Search ..... 340/815.4, 340/286.09, 286.06, 332, 568.1, 568.7, 815.55, 340/815.73, 815.45, 331, 321; 362/122, 362/186, 190, 208, 251, 162, 188; 116/321, 116/202

See application file for complete search history.

(56) References Cited

U.S. PATENT DOCUMENTS 5,053,749 A * 10/1991 Weiss ..... 340/568.7
5,327,329 A * 7/1994 Stiles ..... 362/545
5,495,081 A * 2/1996 Ipcinski ..... 200/341
5,717,568 A * 2/1998 Clutter et al. ..... 361/683
5,748,083 A * 5/1998 Rietkerk ..... 340/568.2
6,164,796 A * 12/2000 La Chiusa ..... 362/122
7,142,103 B2 * 11/2006 Chen et al. ..... 340/471
2002/0194756 A1 * 12/2002 Osborne ..... 40/124.02

OTHER PUBLICATIONS

Switches with Lamp—All Products Online for Switches with Lamp Manufacturer, www.allproducts.com, printed Aug. 2, 2005, p. 1-4.
Omron Pushbutton Switches/Pilot Lights, Nov. 2001, p. 1-23, Omron Electronics Inc., Schaumburg, IL, www.omron.com, printed Aug. 2, 2005.

* cited by examiner

*Primary Examiner*—Anh V La
(74) *Attorney, Agent, or Firm*—James F. Harvey, III

(57) ABSTRACT

A server signaler includes a lamp and a housing containing a battery and a switch. The server signaler may be attached to an advertising support or placed directly on a table top or other surface. Actuation of the switch illuminates the lamp to alert the server that service is required. Another server signaler according to applicant's invention includes an elongated base and telescoping portions to extend the lamp upwardly above the elongated base. Another server signaler provides a card-receiving channel containing switch contacts which are closed by insertion of a card into the channel.

22 Claims, 7 Drawing Sheets

SERVER SIGNALER

BACKGROUND OF THE INVENTION

1. Background

Applicant's server signaler provides a signaling device which includes a light, a housing, a battery, and a switch, which may be placed on a tabletop, an advertising support (also referred to, from time to time, as a table topper), or other support. The invention is also referred to herein, from time to time, as a tabletop signaler or a table top notifier.

2. Discussion

Part of a restaurant's reputation is based on service. This aspect is very often measured by the performance of a waiter or waitress. A common problem when dining in a restaurant is the inability of the server to know when services are needed. Similarly, the diners need to be able to notify the server they need something or are ready to order. Applicant's tabletop signaler provides diners with the ability to notify their waiter or waitress quietly and effectively that they need something. The server signaler may be attached to an advertising support, attached to a wall, or placed directly on the table top.

Applicant's table top notifier is adapted for a low cost of manufacture, thereby facilitating a restaurant supplier's furnishing the server signaler.

SUMMARY OF THE INVENTION

A server signaler includes a lamp and a housing containing a battery and a switch. The server signaler may be attached to an advertising support or be placed directly on a table top or other surface. Actuation of the switch illuminates the lamp to alert the server that service is required. Another server signaler according to applicant's invention includes an elongated base and telescoping portions to extend the lamp upwardly above the elongated base. Another server signaler provides a card-receiving channel containing switch contacts which are closed by insertion of a card into the channel.

DETAILED DESCRIPTION

Figure 1:
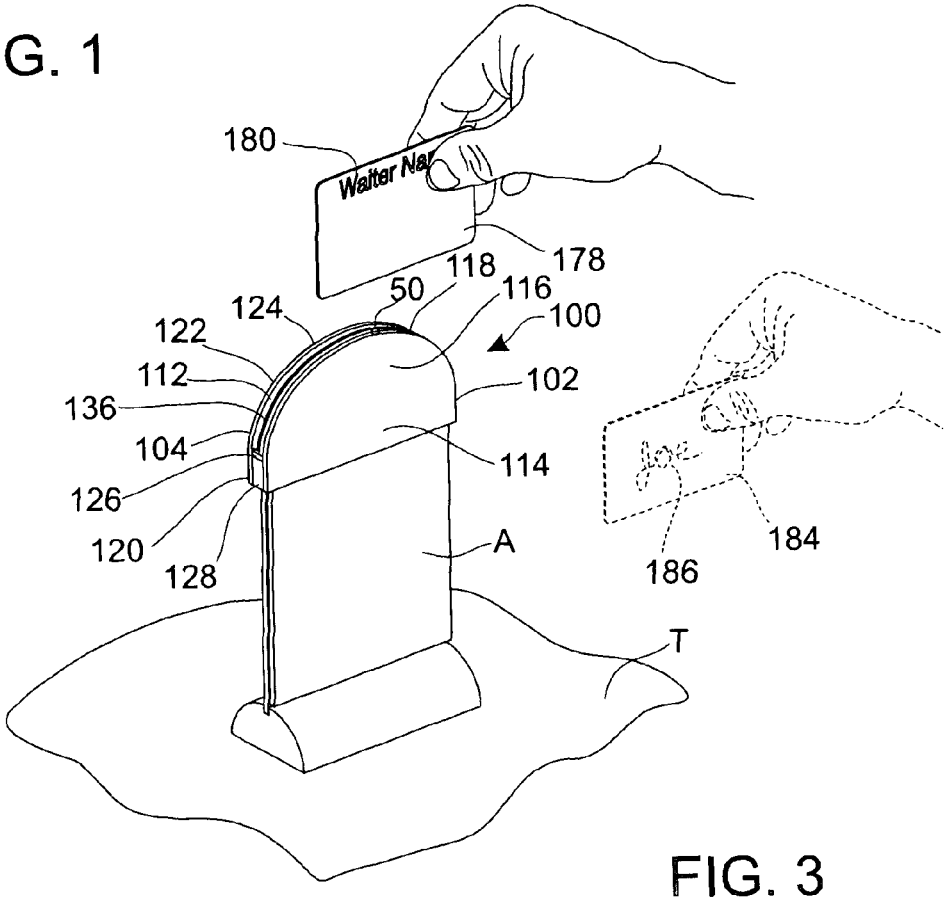
FIG. 1 shows a server signaler according to the present invention wherein a card holder with switchable lamp is attached to an advertising support.

In the following description of the of the present invention, like numerals and characters designate like elements throughout the figures of the drawings.

Referring generally to FIGS. 1-5, a server signaler 100 of the present invention is shown. A front piece 102, a back piece 104, a left side piece 106, a right side piece 108, and a bottom piece 110 are assembled as shown to enclose a card-receiving channel 112. The front piece 102 includes a lower portion 114, an upper portion 116 and a curved upper edge 118. A lamp 50 is affixed to the curved upper edge 118 of the front piece 102. The back piece 104 includes a lower portion 120, an upper portion 122, and a curved upper edge 124. Between the lower portion 114 of the front piece 102 and the lower portion 120 of the back piece 104 a housing 52 is formed with the lower portion 114 of the front piece 102 as the front wall of the housing 52 and the lower portion 120 of the back piece 104 as the back wall of the housing 52. The housing 52 is completed by an elongated top piece 126, a smaller left side piece 128, a smaller right side piece 130 (not shown) and an elongated bottom piece 132 (not shown).

Although the server signaler 100 has been described as an assembly of pieces, it will be understood by one skilled in the art that the server signaler 100 could be molded and then modified as necessary to contain a battery-switch-lamp assembly.

Figure 2:
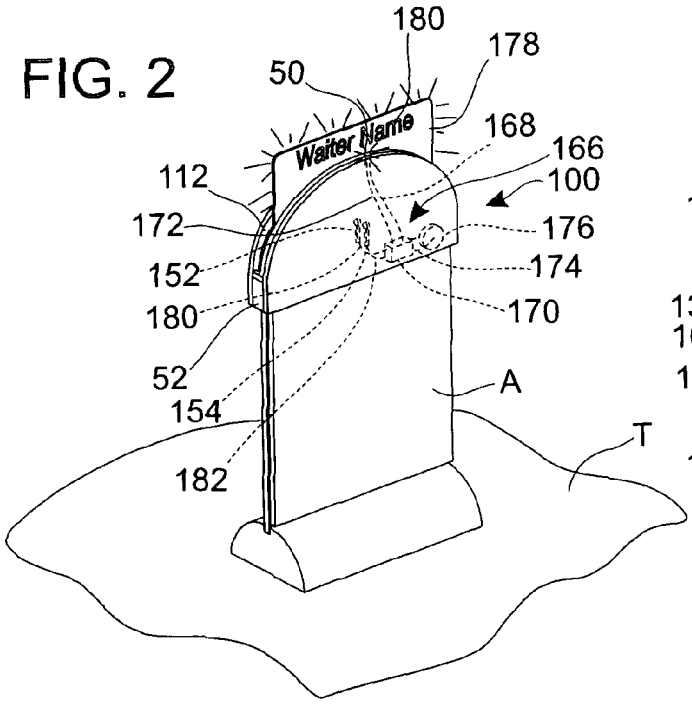
FIG. 2 is another view of the server signaler shown in FIG. 1 of the present invention wherein the server signaler has been activated by the insertion of a card.

Referring now to FIGS. 1-2, the server signaler 100 with card-receiving channel 112 is placed atop an advertising support A which is supported by a surface T. Although the surface T will most commonly be a table top, it will be understood by one skilled in the art that the surface T can be any horizontal surface (if the server signaler 100 rests on the surface T) or other surface (if the server signaler 100 is attached to the surface by double-sided tape, a hook-and-loop fastener, or the like).

It will be further understood by one skilled in the art that while the lamp 50 shown for purposes of illustration in FIGS.

1-3 is a light emitting diode (LED), any convenient lamp can be used including, without limitation, incandescent bulbs and halogen lamps.

Figure 3:
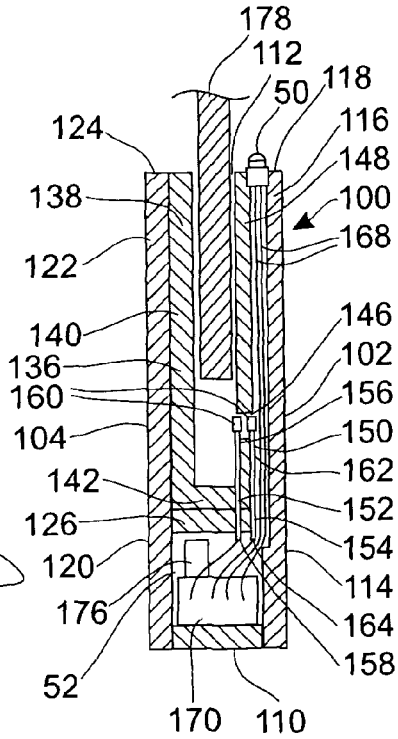
FIG. 3 is a cross-sectional view of the server signaler shown in FIG. 1.

Referring now to FIGS. 1-3, the card-receiving channel 112 is formed by the insertion of an inner lining 136 disposed between the upper portion 116 of the front piece 102 and the upper portion 122 of the back piece 104. The inner lining 136 includes a J-shaped stationary section 138 formed by a long vertical section 140, a short horizontal section 142 and a short vertical section 144. The long vertical section 140 is fixed to the inner side of the upper portion 122 of the back piece 104, while the short horizontal section 142 is fixed to the top of the elongated top piece 126 of the housing 52, and the short vertical section 144 is fixed to the inner side of the upper portion 116 of the front piece 102. Above the short vertical section 144 is a notch 146, and a single vertical piece 148. The notch 146 contains a contact switch 150 made up of a movable contact member 152 and a fixed contact member 154. The movable contact member 152 has an upper portion 156, a lower portion 158, and a contact 160. The fixed contact member 154 has an upper portion 162, lower portion 164, and a contact 160.

Still referring to FIGS. 1-3, the normally open contact switch 150 is forced closed when a preprinted transparent card 178 is inserted into the channel 112. When the preprinted transparent card 178 is inserted into the channel 112, the contact 160 on the upper portion 156 of the movable contact member 152 is pressed against the contact 160 on the upper portion 162 of the fixed contact member 154, thereby closing the contact switch 150 and actuating a switched circuit to illuminate the lamp 50. When the lamp 50 is switched on, the light given off by the lamp 50 shines through the preprinted transparent card 178 and illuminates writing 180 on the preprinted card 178.

Referring again to FIG. 1, it will be further understood by one skilled in the art that while a pre-printed transparent card 178 is shown for purposes of illustration, a clear plastic card 184 with acceptable wax pencil handwriting 186 (see FIG. 5), a clear plastic card 184 with wax pencil writing, a fresnel lens, a credit card, or any convenient card is contemplated in the spirit of applicant's invention.

Referring once again to FIG. 2, a circuit 166 is shown inside the housing 52 and the card-receiving channel 112. Wire leads 168, 172 connect the lamp 50 to terminals of a terminal block 170. Wire leads 174 (two) connect the terminal block switch 170 to the poles of a battery 176. Wire leads 181, 182 connect the movable contact member 152 and the fixed contact member 154 to the terminal block 170.

The contact switch 150 shown in FIGS. 2-3 is a common contact switch. It will be understood by one skilled in the art that various types of contacts or switches can be utilized according to applicant's invention. Micro switches, magnetic reed switches, contact switches and mercury switches are known in the art and suitable for use in applicant's server signaler 100 (see FIG. 28).

Referring once again to FIG. 3, a cross sectional view of the server signaler 100 of the present invention is shown. As previously mentioned, the server signaler 100 includes a front piece 102, a back piece 104. The front piece 102 includes a lower portion 114, an upper portion 116 and a curved upper edge 118. A lamp 50 is fixed to the curved upper edge 118 of the front piece 102. The back piece 104 includes a lower portion 120, an upper portion 122, and a curved upper edge 124. Between the lower portion 116 of the front piece 102 and the lower portion 116 of the back piece 104 a housing 52 is formed with the lower portion 114 of the front piece 102 as the front wall of the housing 52 and the lower portion 120 of the back piece 104 as the back wall of the housing 52. The housing 52 is completed by an elongated top piece 126, and an elongated bottom piece 110.

Still referring to FIG. 3, the housing 52 encloses the battery 176, the terminal block 170, and one end of each of the wire leads 168, 172, 181, and 182.

Figure 4:
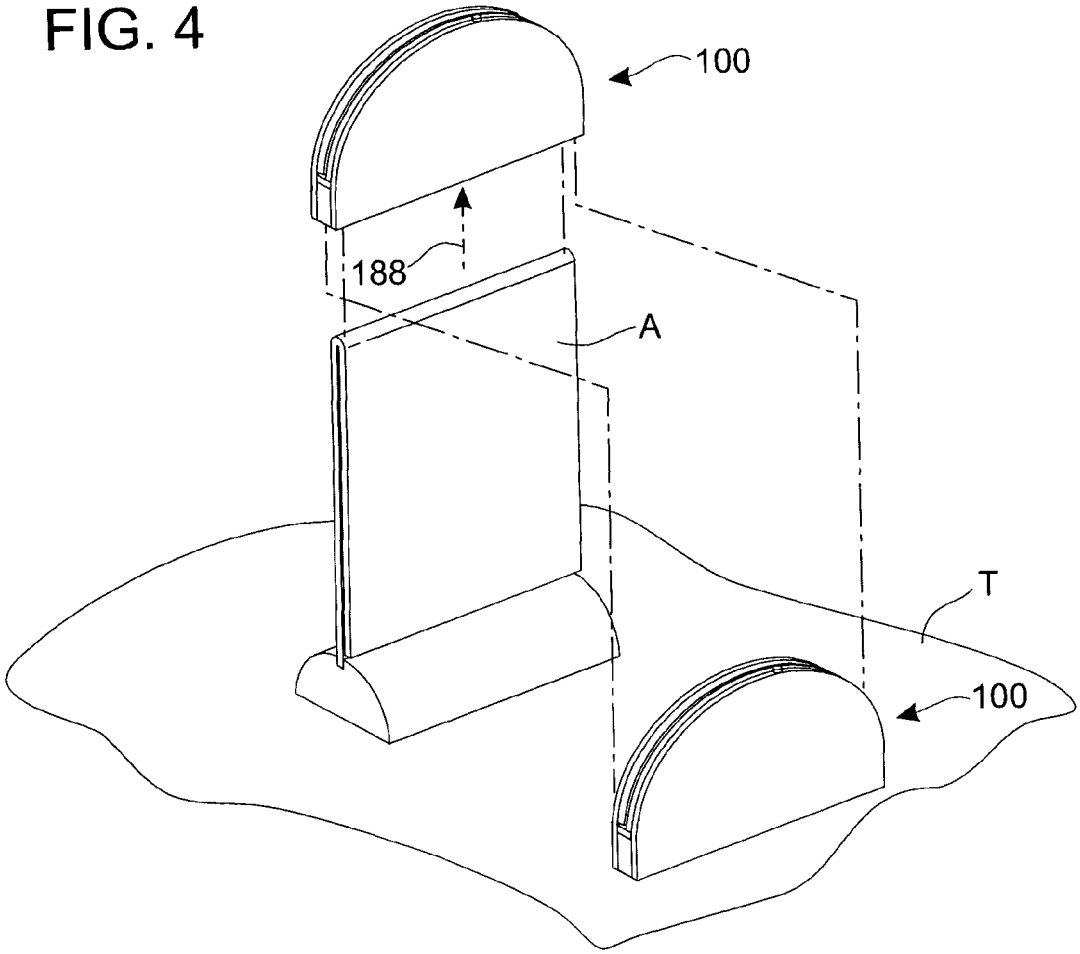
FIG. 4 shows the server signaler of FIG. 1 exploded away from the advertising support.

Referring now to FIG. 4, the server signaler 100 is shown removed from the advertising support A. The server signaler 100 is lifted upwardly along 188 and then placed directly on the surface T.

Figure 5:
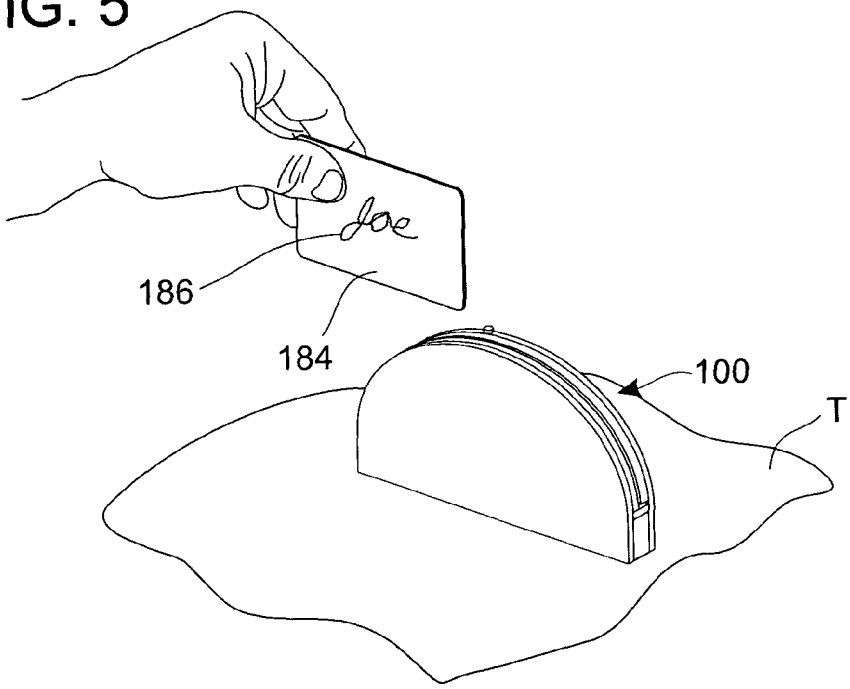
FIG. 5 shows the server signaler of FIG. 1 placed directly on a table top.

Referring now to FIG. 5, the server signaler 100 (rear view) according to the present invention is shown resting on a table top T. A clear plastic card 184 with wax pencil handwriting 186 is shown ready for insertion into the server signaler 100. It will be further understood by one skilled in the art that while the clear plastic 184 is described as clear, any non-opaque material could be used including, without limitation, any suitable plastic card material.

Figure 6:
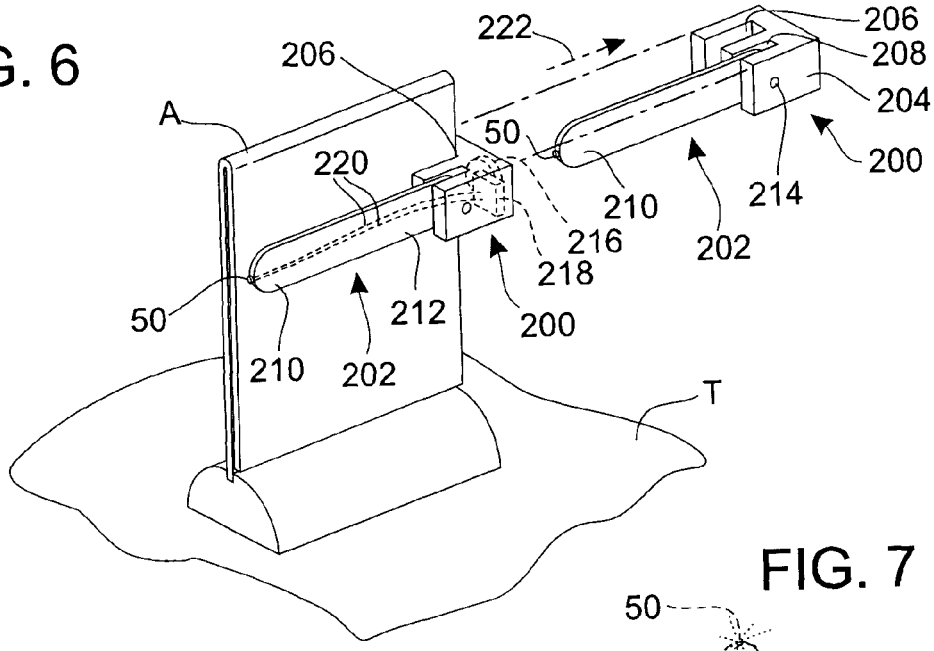
FIG. 6 shows another server signaler according to applicant's invention.
Figure 7:
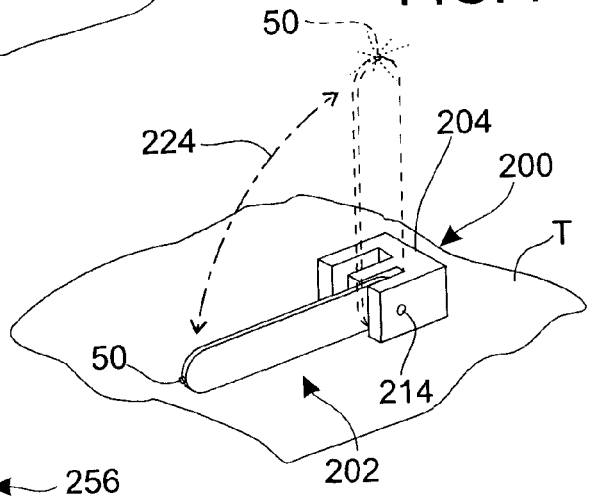
FIG. 7 shows the server signaler of FIG. 6 placed on a table top.

Referring generally to FIGS. 6-7, another server signaler 200 according to the present invention includes a swing arm 202 with a lamp 50 movably mounted in an E-shaped member 204. The E-shaped member 204 has a larger channel 206 and a smaller channel 208. The swing arm 202 has an outer portion 210 and an inner portion 212. The lamp 50 is mounted on the outer portion 210 of the swing arm 202. The inner portion 212 of the swing arm 202 is received by the smaller channel 208 of the E-shaped member 204 and held in place by a pin 214. The larger channel 206 receives the advertising support A for attachment of the server signaler 200 thereto.

Referring now to FIG. 6, a battery 216 and a switch 218 are housed within the E-shaped member 204. Lamp leads 220 travel through the inside of the swing arm 202 to the lamp 50 and then back to the switch 218. See FIG. 28 for a stylized schematic of various types of switches for use in the server signaler 200. The server signaler 200 travels along 222 for removal from the advertising support A.

Referring again to FIGS. 6-7, the pin 214 allows the swing arm 202 to rotate along 224 between a vertical position (for actuation of the switched circuit) and a horizontal position, wherein the switched circuit is switched off.

Referring now to FIG. 7, the server signaler 200 has been placed directly on the surface T. With the E-shaped member 204 resting on the surface T, the swing arm 202 is still free to travel along 224 to switch the lamp 50 on (in the vertical position) and off (in the horizontal position).

Figure 8:
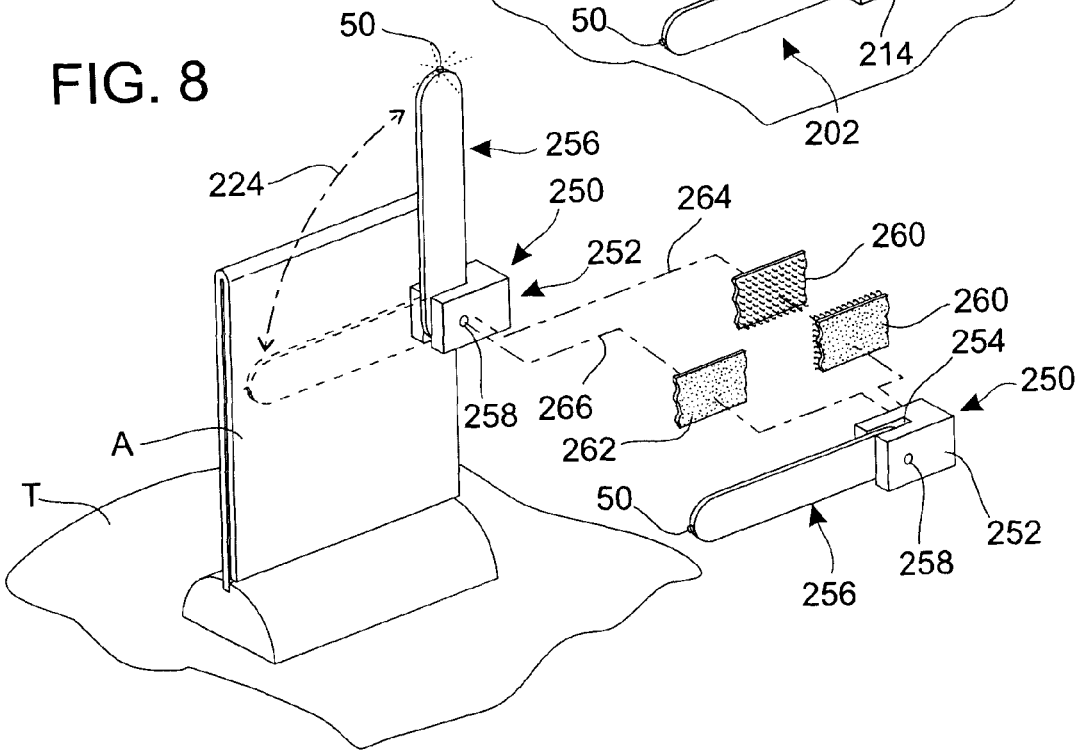
FIG. 8 shows another server signaler according to applicant's invention.

Referring now to FIG. 8, another server signaler 250 includes a single channel mounting bracket 252 having a channel 254 which receives a swing arm 256 held in place by a pin 258. The single channel mounting bracket 252 may travel along 264 to be attached to the advertising support A by the use of a hook and loop fastener 260, or the single channel mounting bracket 252 may travel along 266 to be attached to the advertising support A by the use of a double sided adhesive strip 262. It will be understood by one skilled in the art that methods of attachment of the server signaler 250 to the advertising support could include, without limitation, the hook and loop fastener 260 or the double-sided adhesive strip 262. It would also be understood by one skilled in the art that the single channel mounting bracket could be placed on a front or back side of the advertising support A. The single channel mounting bracket houses a battery 268 (not shown), a terminal block 270 (not shown), lamp leads 272 (not shown), and battery leads 274 (not shown).

Referring generally to FIGS. 9-15, another server signaler 300 with a swing arm 302 includes a top mounting member 304, a mounting channel 306, a notch 308, a pin 310, and a lamp 50. The swing arm 302 includes an inner portion 312 and an outer portion 314. The notch 308 receives the inner portion 312 of the swing arm 302 and is held in place by the pin 310. The lamp 50 is mounted at the end of the outer portion 314 of the swing arm 302. The pin 310 allows the swing arm 302 to travel along 316 between a horizontal position (wherein the switched circuit is not actuated) and a vertical position wherein the lamp 50 is illuminated.

Figure 9:
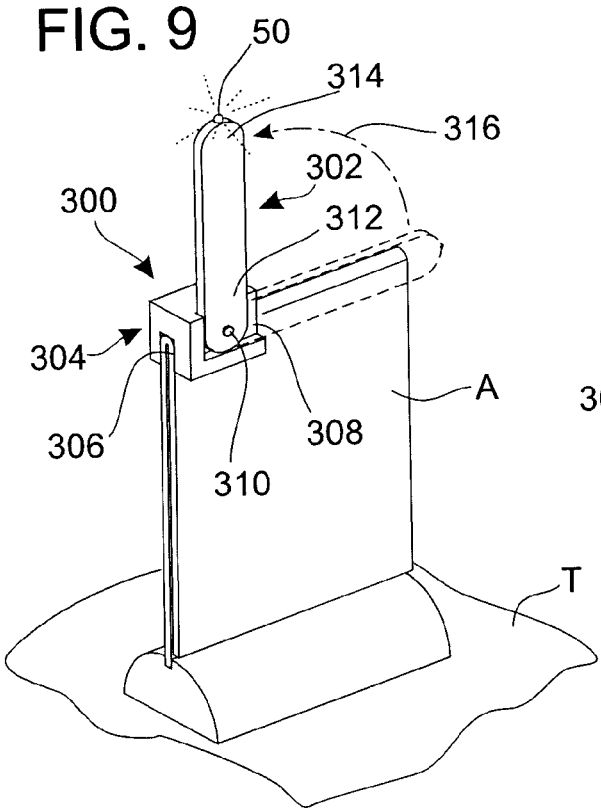
FIG. 9 shows another server signaler according to applicant's invention.
Figure 10:
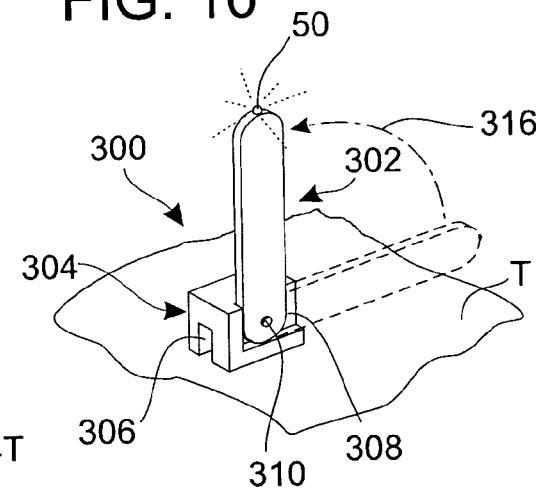
FIG. 10 shows the server signaler of FIG. 9 placed on a table top.
Figure 11:
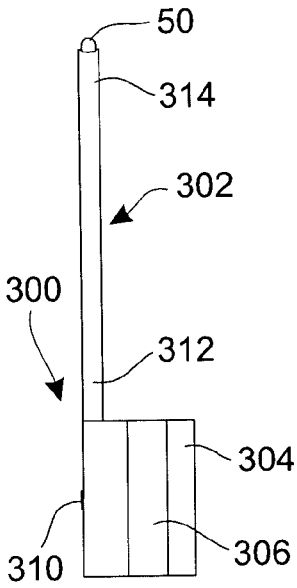
FIG. 11 is a bottom view of the server signaler shown in FIG. 10.
Figure 12:
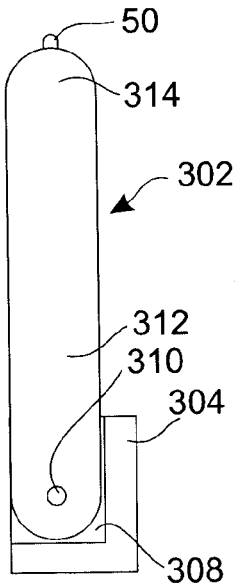
FIG. 12 is another view of the server signaler shown in FIG. 10.
Figure 13:
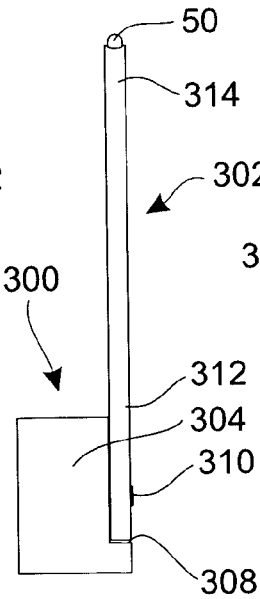
FIG. 13 is top view of the server signaler shown in FIG. 10.
Figure 14:
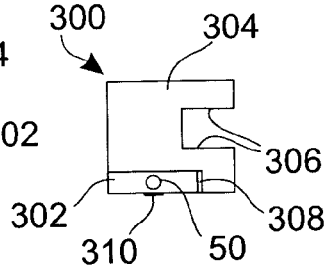
FIG. 14 is another view of the server signaler shown in FIG. 10.
Figure 15:
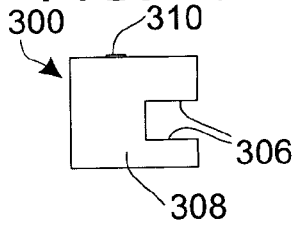
FIG. 15 is another view of the server signaler shown in FIG. 10.

Referring now to FIGS. 9-10, the top mounting member 304 rests on top of the advertising support A (as in FIG. 9) or the top mounting member 304 may be placed on any horizontal surface T (as in FIG. 10). Although the surface T will most commonly be a table top, it will be understood by one skilled in the art that the surface T can be any horizontal surface if the server signaler 300 rests on the surface T or other surface if the server signaler 300 is attached to the surface by double-sided tape, a hook-and-loop fastener, or the like (see FIG. 8). When the server signaler 300 is on either surface, the swing arm 302 travels along 316 between a horizontal position (wherein the switched circuit is not actuated) to a vertical position wherein the lamp 50 is illuminated.

Referring now to FIGS. 11-15, the server signaler 300 includes the swing arm 302, the top mounting member 304, the mounting channel 306, the notch 308, the pin 310, and the lamp 50. It would be understood that inside the top mounting member 304 houses a battery 318 (not shown), a terminal block 320 (not shown), a contact 322 (not shown), and lamp leads 324 (not shown).

Figure 16:
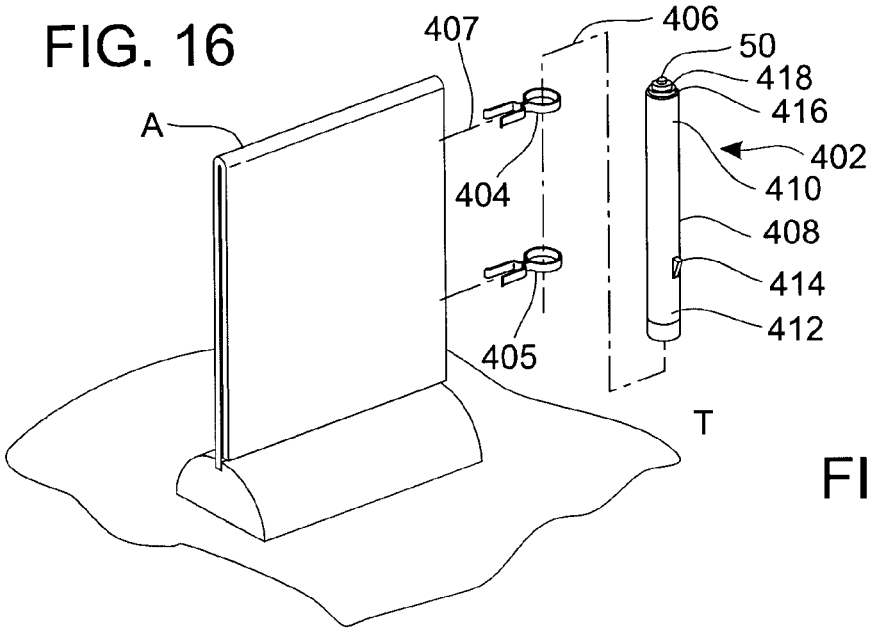
FIG. 16 shows another server signaler according to applicant's invention wherein the server signaler is exploded away from the advertising support.
Figure 18:
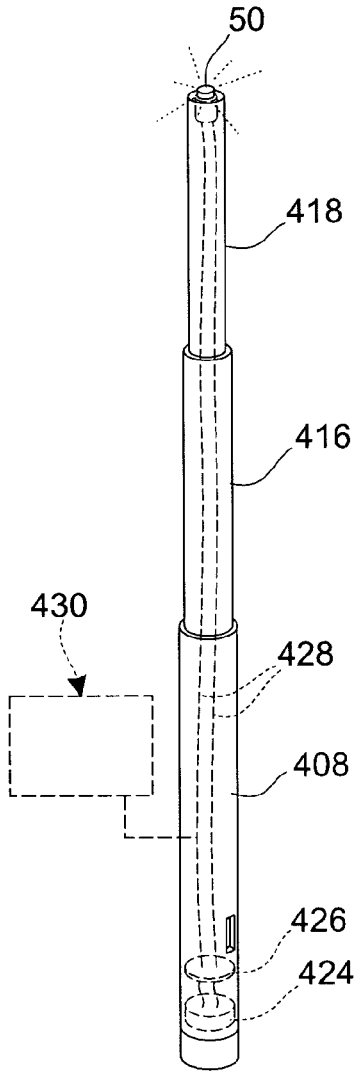
FIG. 18 is another view of the server signaler shown in FIG. 16.
Figure 17:
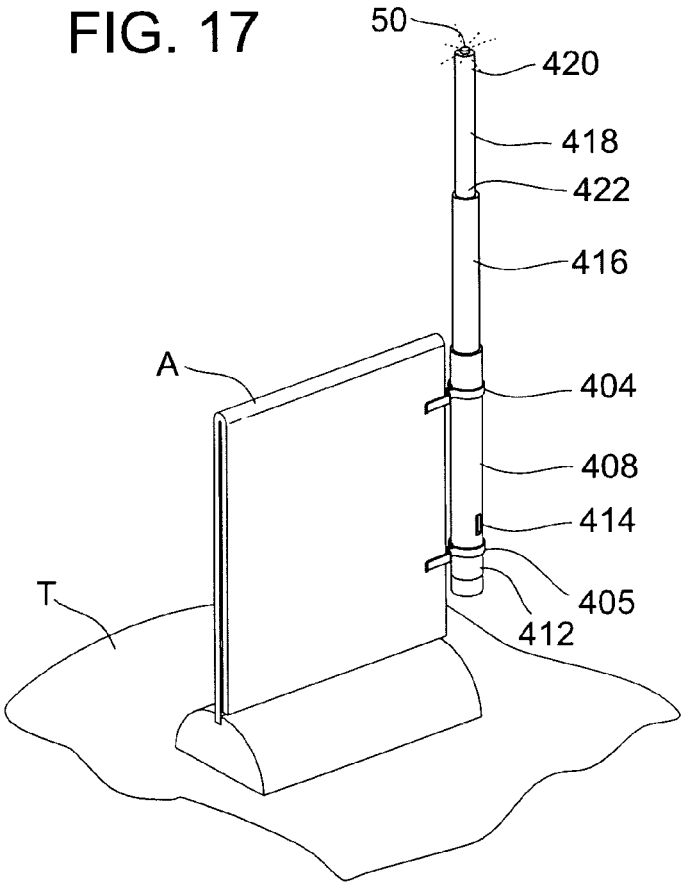
FIG. 17 is another view of the server signaler shown in FIG. 16.

Referring generally to FIGS. 16-18, another server signaler 400 according to the present invention includes a penlight-style body 402 and clips 404, 405. The penlight-style body 402 includes an elongated case 408 having an upper portion 410 and a lower portion 412. On the lower portion 412 of the case 408 is a button 414. A clip 404 encircles the upper portion 410 of the case 408, and another clip 405 encircles lower portion 412 of the case 408. Inside the case 408 is an intermediate telescopic portion 416 and an end telescopic portion 418. The end telescopic portion 418 includes an outer portion 420 and an inner portion 422. A lamp 50 is mounted on the edge of the outer portion 420 of the end telescopic portion 418.

Referring now to FIG. 16, the server signaler 400 moves along 406 to be inserted into the clips 404,405. The clips 404,405 then travel along 407 to connect to the advertising support A. As shown, the server signaler 400 is mounted onto the right side of the advertising support A, but it would be understood that this server signaler 400 could be attached to either side of the advertising support A.

Referring now to FIG. 17, the button 414 located on the lower portion 412 of the case 408 has been pressed inward to deploy the intermediate telescopic portion 416 and the end telescopic portion 418. The lamp 50 on the tip of the end telescopic portion 418 illuminates when the telescopic portions 416, 418 are fully extended.

Referring now to FIG. 18, the case 408 serves as a housing for a battery 424, a terminal block 426, and lamp leads 428. A switch actuates the switched circuit when the telescopic portions 416, 418 are fully extended.

Figure 19:
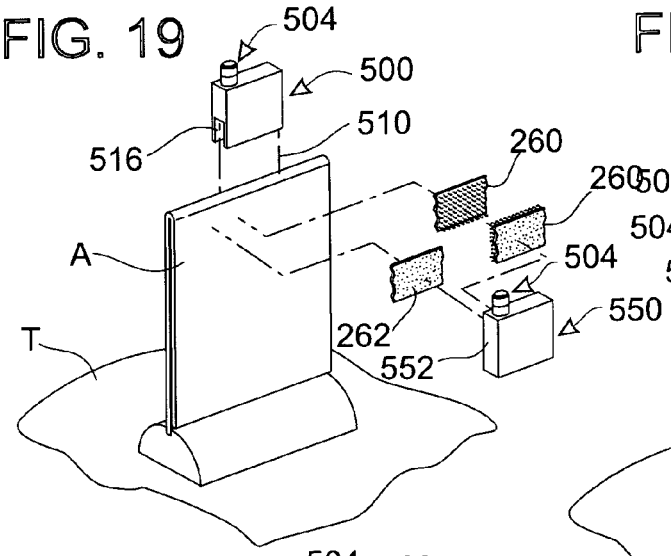
FIG. 19 shows two additional server signalers according to applicant's invention.

Referring generally to FIGS. 19-27, another server signaler 500 includes a top mounting member 502 which supports a push button lamp switch 504. The push button lamp switch 504 has an outer switch portion 506 and an inner switch portion 508, a lamp 50 and a mounting channel 516. The top mounting member 502 includes a top surface 512, generally parallel to the mounting channel 516. Another server signaler 550, without the mounting channel 516, includes a surface mountable housing 552 and a push button lamp 504. A battery (not shown) is housed within the surface mountable housing. FIG. 19 illustrates movement of the server signaler 500 along 510 for attachment to (or removal from) the top of the advertising support A.

Still referring to FIGS. 19-27, the server signaler 500 and the server signaler 550 may be placed directly on any surface T. In the alternative, the server signalers 500, 550 may be attached to the advertising support A using a hook-and-loop fastener or a double-sided adhesive strip.

Figure 20:
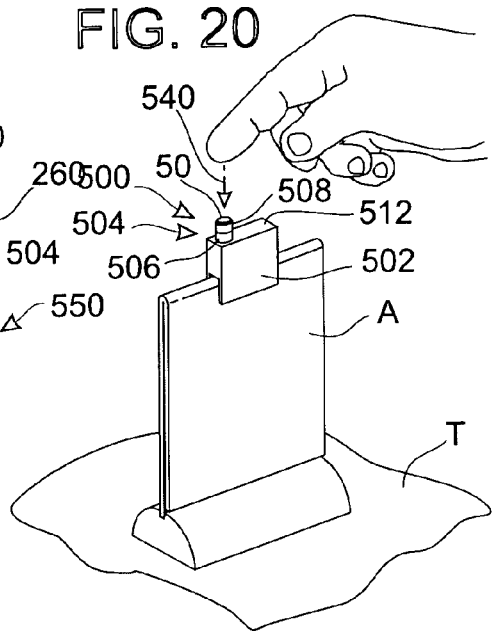
FIG. 20 is another view of one of the server signalers shown in FIG. 19.

Referring now to FIG. 20, the push button lamp switch 504 includes the outer switch portion 506, the inner switch portion 508, and the lamp 50. The outer switch portion 506 is fixed to the top 512 of the top mounting member 502, while in inner switch portion 508 protrudes from within the outer switch portion 506. The lamp 50 is mounted onto the top of the inner switch portion 508. When the lamp 50 is pressed downward along 540, the inner switch portion 508 slides inside of the outer switch portion 506. When the inner switch portion 508 is pressed in completely, contacts 514 (not shown) are closed. The contacts 514 are reopened by pressing the inner switch portion 508 down again into the outer switch portion 506. When the contacts 514 are closed the lamp 50 is illuminated until the contact 514 is reopened. Push-button lamps are well known, and it will be understood by one skilled in the art that applicant's invention consists of the combination of a push-bottom lamp and a mounting member which houses a battery to energize the switched circuit.

Figure 21:
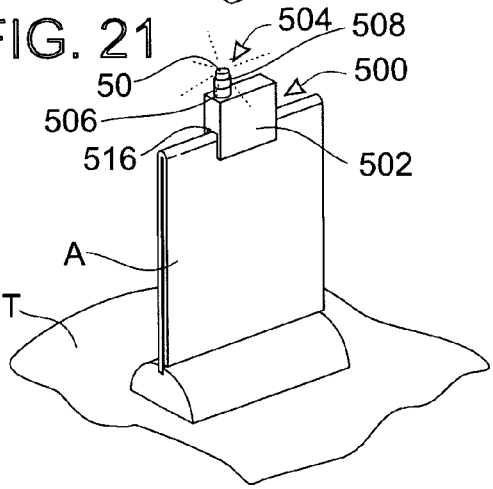
FIG. 21 is another view of the server signaler shown in FIG. 20.
Figure 22:
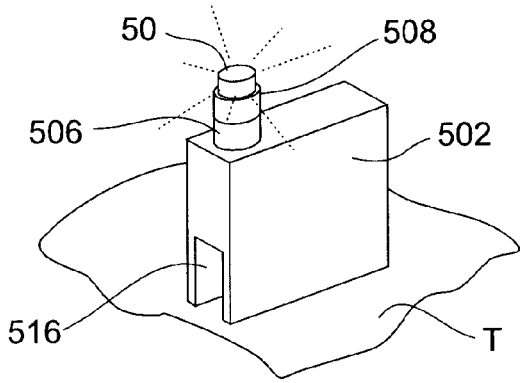
FIG. 22 shows the server signaler of FIG. 20 placed directly on a table top.
Figure 23:
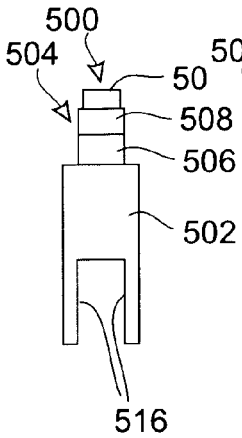
FIG. 23 is another view of the server signaler of FIG. 20.
Figure 24:
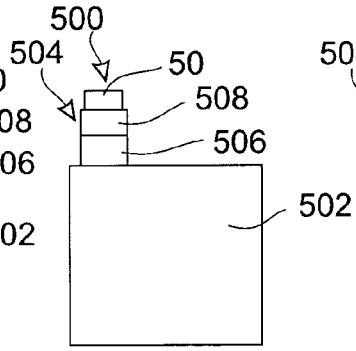
FIG. 24 is another view of the server signaler of FIG. 20.
Figure 25:
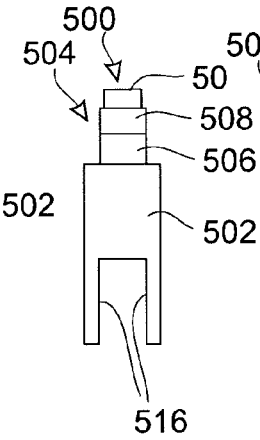
FIG. 25 is another view of the server signaler of FIG. 20.
Figure 26:
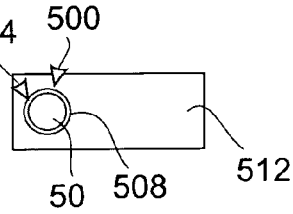
FIG. 26 is another view of the server signaler of FIG. 20.
Figure 27:
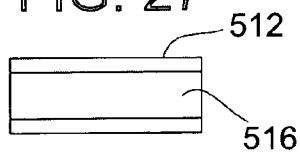
FIG. 27 is another view of the server signaler of FIG. 20.

Referring now to FIGS. 21-22, the server signaler 500 may be removed from the advertising support A placed on any surface T. The mounting channel 516 receives the top of the advertising support A as in FIG. 21 or may rest on any horizontal surface T, as in FIG. 22. Although the surface T will most commonly be a table top, it will be understood by one skilled in the art that the surface T can be any horizontal surface (if the server signaler 500 rests on the surface T) or other surface (if the server signaler 500 is attached to the surface by double-sided tape, a hook-and-loop fastener, or the like).

Referring now to FIGS. 23-27, the server signaler 500 includes a top mounting member 502, a push button lamp switch 504 with an outer switch portion 506 and an inner switch portion 508, a lamp 50 and a mounting channel 516. The top mounting member includes a top surface 512, parallel to the mounting channel 506. It would be understood that inside the mounting member 502 is a battery 518 (not shown), a terminal block 520 (not shown), and lamp leads 522 (not shown).

Figure 28:
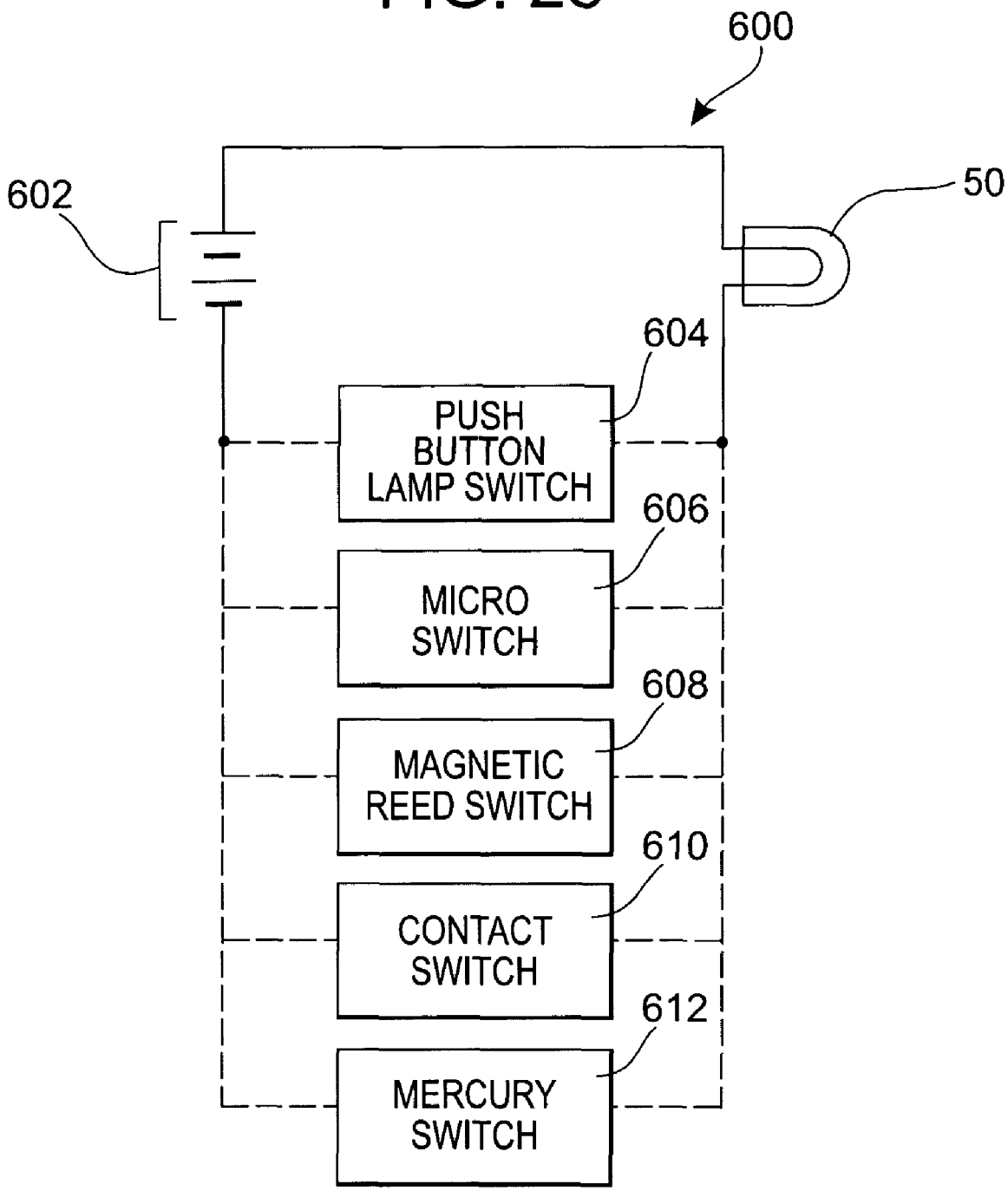
FIG. 28 is a stylized circuit diagram of a battery-switch-lamp arrangement according to applicant's invention.

Referring now to FIG. 28, a stylized circuit diagram 600 shows a lamp 50 powered by a battery 602 actuated by, in the alternative, a push button lamp switch 604, a micro switch 606, a magnetic reed switch 608, a contact switch 610, or a mercury switch 612. Each switch set forth herein is known in the art and, therefore, will not be discussed in detail. Any type of switch can be used in applicant's server signaler invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

I claim:

1. A self-contained battery-operated server signaler attached to an advertising support for signaling a server that service is needed, comprising:

a body having a front piece with a top portion and a bottom portion, a back piece with a top portion and a bottom portion, a bottom piece connecting the bottom portions of the front piece and the back piece, and a top piece interposed intermediate the top and bottom portions of the front piece and the top and bottom portions of the back piece, wherein the top piece, the bottom portion of the front piece, the bottom portion of the back piece and the bottom piece define a housing therewithin;

a card-receiving channel between the top portion of the front piece, the top portion of the back piece, and the top piece;

a lamp mounted on a selected top portion of the front piece and the back piece that comprise the body; and a circuit with a battery contained within the housing, the circuit actuating the lamp in response to a switch.

2. The signaler of claim 1, further comprising attachment means for attaching the body to the advertising support.

3. The signaler of claim 2, wherein the advertising support has a generally horizontal upper edge and the body includes a lower channel adapted for receiving the generally horizontal upper edge of the advertising support, wherein the server signaler is supported by the advertising support.

4. The signaler of claim 2, wherein the body is attached to the advertising support by an item selected from a group consisting of a hook-and-loop fastener, double-sided adhesive tape, and an adhesive.

5. The signaler of claim 1, wherein the switch is selected from a group consisting of a micro switch, a magnetic reed switch, a contact switch, and a mercury switch.

6. The signaler of claim 1 wherein a push button lamp switch provides both the lamp and the switch.

7. The signaler of claim 1, wherein the switch is located in the body adjacent the card-receiving channel, and wherein a card placed within the card-receiving channel actuates the switch to illuminate the lamp.

8. The signaler of claim 7, wherein the card is transparent.

9. The signaler of claim 7, wherein the card is translucent.

10. The signaler of claim 8, wherein the card is preprinted with a name of a server.

11. A self-contained battery-operated server signaler for signaling a server that service is needed, comprising:

a bracket;

a swing arm pivotally attached to the bracket so the swing arm moves between a generally horizontal position and a generally vertical position;

a lamp attached to the swing arm distal from the bracket; and switch means controlled by movement of the swing arm for operation of the lamp, wherein the lamp is illuminated by manually moving the swing arm to the generally vertical position and the lamp is extinguished by manually moving the swing arm to the generally horizontal position.

12. The signaler of claim 11, further comprising an attachment means for attaching the bracket to the advertising support.

13. The signaler of claim 12, wherein the advertising support has a generally horizontal upper edge and the bracket includes a channel receiving the generally horizontal upper edge of the advertising support, wherein the server signaler is supported by the advertising support.

14. The signaler of claim 12, wherein the bracket is attached to the advertising support by an item selected from a group consisting of a hook-and-loop fastener, double-sided adhesive tape, and an adhesive.

15. The signaler of claim 11, wherein the switch means is selected from a group consisting of a micro switch, a magnetic reed switch, a contact switch, and a mercury switch.

16. The signaler of claim 11, wherein a push button lamp switch provides both the lamp and the switch means.

17. A self-contained battery-operated server signaler for use with an advertising support, the server signaler comprising:

an elongated case having an intermediate telescoping portion and an end telescoping portion disposed therein;

a lamp attached to the end telescoping portion distal from the elongated case;

a battery contained within the elongated case;

a first switch means, wherein the first switch means illuminates the light when both the intermediate telescoping portion and the end telescoping portion are fully extended and extinguishes the light when the intermediate and end telescoping portions are not fully extended; and a second switch means attached to the elongated case wherein the second switch means controls extension and retraction of the intermediate and end telescoping portions.

18. The signaler of claim 17, further comprising attachment means for attaching the elongated case to the advertising support.

19. The signaler of claim 18, wherein the attachment means further comprises at least one clip.

20. The signaler of claim 18, wherein the attachment means further comprises a hook-and-loop fastener.

21. The signaler of claim 18, wherein the attachment means further comprises double-sided adhesive tape.

22. The signaler of claim 18, wherein the elongated case is adhesively attached to the advertising support.

* * * * *